US012091779B2

(12) United States Patent
Francalanci et al.

(10) Patent No.: US 12,091,779 B2
(45) Date of Patent: Sep. 17, 2024

(54) INTEGRATED AND IMPROVED PROCESS FOR THE PRODUCTION OF ACRYLIC FIBERS

(71) Applicant: Montefibre Mae Technologies S.r.l., Milan (IT)

(72) Inventors: Franco Francalanci, Uzzano (IT); Luca Bellardi, Cremona (IT); Vittoria Brogni, Piacenza (IT)

(73) Assignee: Montefibre Mae Technologies S.r.l., Milan (IT)

( * ) Notice: Subject to any disclaimer, the term of this patent is extended or adjusted under 35 U.S.C. 154(b) by 258 days.

(21) Appl. No.: 17/588,510

(22) Filed: Jan. 31, 2022

(65) Prior Publication Data

US 2022/0243364 A1 Aug. 4, 2022

(30) Foreign Application Priority Data

Feb. 3, 2021 (IT) ..... 102021000002324

(51) Int. Cl.

| | |
|---|---|
| ***D01F 6/18*** | (2006.01) |
| ***D01D 1/02*** | (2006.01) |
| ***D01D 1/10*** | (2006.01) |
| ***D01D 5/38*** | (2006.01) |

(52) U.S. Cl.

CPC ..... *D01F 6/18* (2013.01); *D01D 1/02* (2013.01); *D01D 1/106* (2013.01); *D01D 5/38* (2013.01)

(58) Field of Classification Search

CPC . D01F 6/18; D01D 1/02; D01D 1/106; D01D 5/38

See application file for complete search history.

(56) References Cited

U.S. PATENT DOCUMENTS

| | | | | |
|---|---|---|---|---|
| 3,641,233 | A | 2/1972 | Cesare et al. | |
| 2018/0265648 | A1* | 9/2018 | Francalanci | C08F 220/46 |
| 2019/0249029 | A1* | 8/2019 | Gibanel | B05D 7/14 |
| 2022/0041766 | A1* | 2/2022 | Marinetti | C08F 20/44 |

FOREIGN PATENT DOCUMENTS

| | | | |
|---|---|---|---|
| EP | 3375915 | A1 | 9/2018 |
| GB | 989765 | A | 4/1965 |

OTHER PUBLICATIONS

Fiocco, Marco, "Search Report and Written Opinion of the Ufficio Italiano Brevetti e Marchi for Italian Application No. 102021000002324," Italian Patent and Trademarks Office, The Hague, Oct. 5, 2021.

* cited by examiner

*Primary Examiner* — Mathieu D Vargot
(74) *Attorney, Agent, or Firm* — Florek & Endres PLLC

(57) ABSTRACT

An integrated and improved process for the production of acrylic fibers is described, specifically a process that starts from the comonomers and reaches the spinning step obtaining the final fiber.

20 Claims, 2 Drawing Sheets

INTEGRATED AND IMPROVED PROCESS FOR THE PRODUCTION OF ACRYLIC FIBERS

Figure 1:
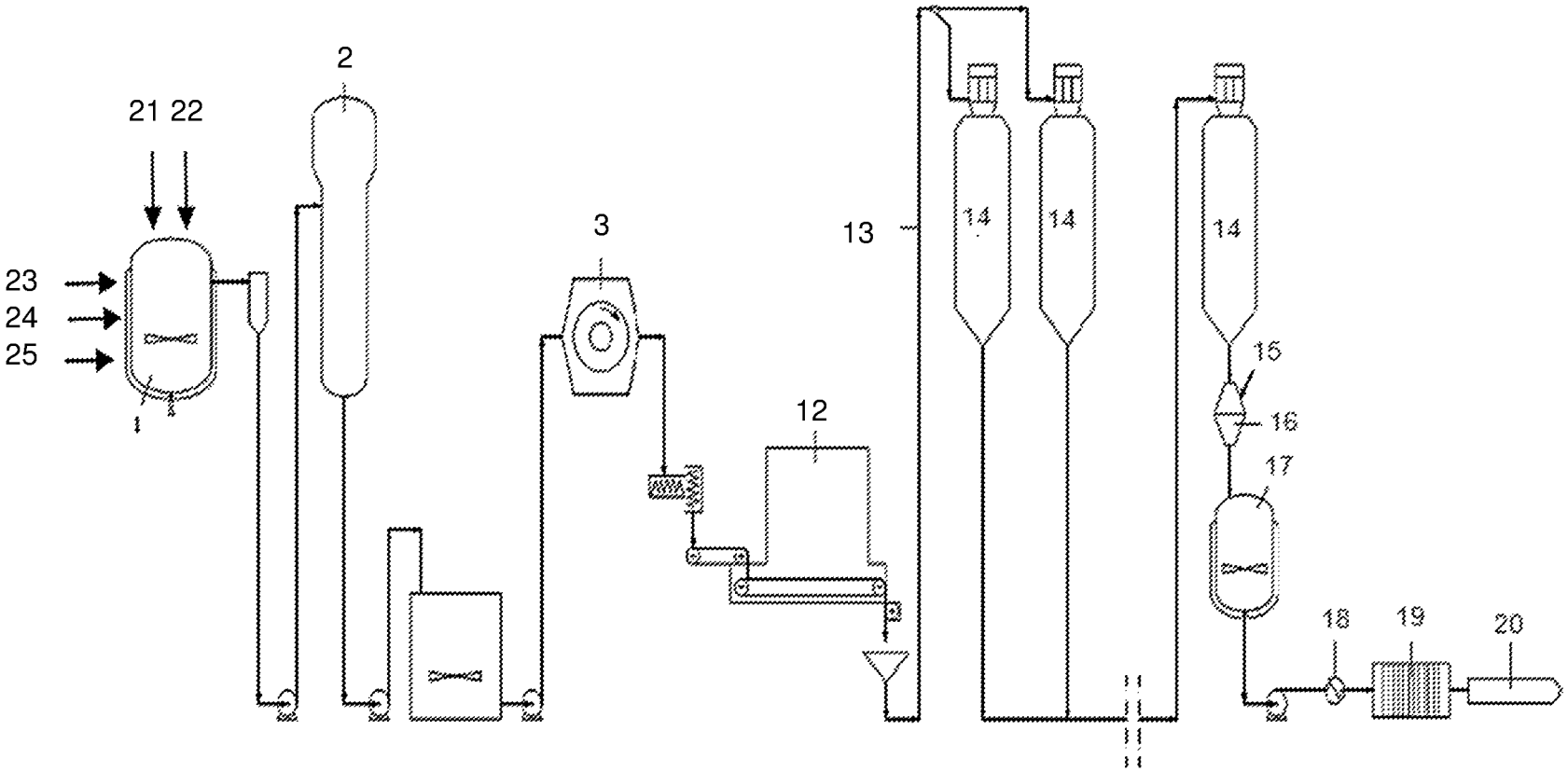

The present invention relates to an integrated and improved process for the production of acrylic fibers, specifically a process that starts from the comonomers and reaches the spinning step, obtaining the final fiber.

More specifically, the present invention falls within the sector relating to the production of acrylic fibers which provides for the preparation of polymers starting from acrylonitrile or copolymers mainly composed of acrylonitrile (90-99% by weight with respect to the total weight of the polymer) and by one or more other comonomers in a quantity generally ranging from 1 to 10% by weight with respect to the total weight of the polymer.

The preferred comonomers are neutral vinyl molecules such as methyl acrylate, methyl methacrylate, vinyl acetate, acrylamide and analogues, or molecules bearing one or more acid groups such as acrylic acid, itaconic acid, sulfonated styrenes and analogues, or other comonomers capable of imparting different chemical-physical characteristics to the polymer thus obtained, such as, for example, vinyl pyridine which makes the material dyeable with anionic dyes.

The polymers and copolymers thus prepared are then subjected to spinning to produce fibers that are collected in tows, suitable for being subsequently transformed into manufactured articles with different processing techniques, for both textile and technical use.

Particular types of acrylic are fiber "precursors" for carbon fibers: these are high-molecular-weight copolymers of acrylonitrile and one or more co-monomers, selected from those described above, in a quantity generally ranging from 1 to 5% by weight with respect to the total weight of the polymer. The carbon fibers are then obtained by means of a suitable thermal treatment of fiber "precursors" based on polyacrylonitrile.

There are various industrial processes for the preparation of acrylic fibers, which use different polymerization and spinning methods.

The state of the art can be divided and schematized as follows:

A. Discontinuous Processes (Two-Step).

In two-step discontinuous processes, the polymer is generally produced in an aqueous suspension, isolated and subsequently dissolved in a suitable solvent to be spun and transformed into fiber or fiber precursor in the case of carbon fibers. The solvents most commonly used for the preparation of the spinning solution are: dimethylacetamide (DMAc), dimethylformamide (DMF), an aqueous solution of sodium thiocyanate (NaSCN) and, finally, mixtures of dimethylsulfoxide (DMSO) with varying amounts of water, as recently described in patent EP2894243B1

B. Continuous Processes (One-Step).

In continuous processes, on the other hand, the polymerization takes place in a solvent and the solution thus obtained is directly used in spinning without the intermediate isolation of the polymer. The solvents most commonly used in these processes are: dimethylformamide (DMF), dimethyl sulfoxide (DMSO), aqueous solution of zinc chloride ($ZnCl_2$) and aqueous solution of sodium thiocyanate (NaSCN).

Discontinuous processes have significant advantages from a management point of view: the two polymerization and spinning steps are in fact independent and the traces of impurities and unreacted monomers can be easily separated from the polymer by washing and filtration, before the spinning step.

Processes of this type are consequently much more widely-used in industrial practice for the production of acrylic fibers and represent a substantial share of the production processes of precursor for carbon fiber.

Industrially, discontinuous processes provide for a drying step of the polymer obtained from polymerization in aqueous suspension, which is carried out by means of belt or fluidized bed dryers. The polymer in powder form is then transported to silos where it remains stored until the moment of use. In order to prepare the spinning solution (the dope), the powdered polymer is then closely mixed with the solvent with procedures suitable for obtaining solutions free from lumps and gels. After filtration, the dope is finally sent to the spinning machines. The above process according to the state of the art is schematically described in FIG. 1.

The fiber preparation process, considered in its entirety, however, has various weaknesses that are open to improvement for both optimizing the performance of the products obtained and also in terms of production costs.

A first disadvantage of the process described according to the state of the art lies in the large quantity of water consumed during the polymerization, washing and drying steps of the polymer and, in the case of the production of fiber precursor, also in the spinning step. In this latter case, in fact, the final washing steps of the fiber are carried out with demineralized water in order to completely remove the residual solvent. This washing water is then generally sent to waste water treatment as sending it to the solvent recovery plant would be uneconomical given the very low quantity of solvent contained, which is less than 0.5%.

A second disadvantage, typical of the polymerization step, is that the choice of comonomers is mainly limited to liquid or water-soluble comonomers, whereas solid and insoluble or low water-soluble comonomers are difficult to dose, even if reactive.

Furthermore, the isolation, drying and conveying steps of the polymer in powder form, as also the preparation step of the spinning solution, involve complex and expensive equipment that requires particular attention in terms of safety, as fine, potentially explosive powders, are present in the process. These process steps, moreover, are also severely penalizing from an energy point of view due to the presence of drying units, generally operating with hot air or nitrogen, and units for transporting the polymer in powder form.

EP3375915 has recently described a simplified process that uses the polymerization technology in aqueous suspension followed by spinning through the use of DMSO containing reduced quantities of water as solvent, said process eliminating the drying step of the polymer, its conveyance to the storage silos and the subsequent step for preparing the spinning solution starting from the powders.

A further limitation of traditional two-step processes, in particular in the production of carbon fiber precursor, lies in the difficulty of adding ammonia or primary or secondary amines: these additives are known to significantly contribute to improving the production processes of the precursor, and obtaining high-performance carbon fibers. In the conventional technique, this difficulty is overcome by treating the dope with gaseous ammonia or by adding an additional step in the spinning machines which allows the addition of amines or ammonia in a stretching condition. This step is then followed by a relaxation phase and subsequently a new stretching phase at higher temperatures.

In Italian patent application n. 102019000014880, the addition of aqueous ammonia during the preparation of the dope has recently been described, this solution however is only possible when the solvent used is DMSO containing small amounts of water.

The objective of the present invention is therefore to provide a process for preparing acrylic fibers which overcomes the above-mentioned limitations and disadvantages of the known art and which allows significant advantages to be obtained in terms of product quality and production costs.

DETAILED DESCRIPTION OF THE INVENTION

The present invention relates to a process comprising the following steps:

i) polymerization of comonomers in aqueous suspension in the presence of a quantity of solvent ranging from 3 to 25% by weight, preferably from 5 to 10% by weight, with respect to the total weight of the aqueous suspension, wherein the solvent is the same solvent used in the following steps ii)-vi) and wherein the water which constitutes the aqueous suspension comprises recycled water coming from the last washing step of the spinning step, in an amount ranging from 10 to 40% by weight, preferably from 20 to 30% by weight, with respect to the total weight of the water of the aqueous suspension, said polymerization reaction being catalyzed by a redox ammonium persulfate/ammonium bisulphite pair in the presence of catalytic quantities of iron sulfate, with the subsequent removal of the unreacted monomers, filtration of the aqueous suspension and washing of the same, obtaining a filtration cake comprising polymer and water with traces of solvent in a ratio ranging from 40/60 to 60/40 by weight, preferably in a weight ratio equal to or higher than 1:1;

ii) dispersion of said first filtration cake obtained in step i) in a solvent/water mixture or in a pure solvent in a weight ratio ranging from 2 to 10 times the weight of the cake, preferably at a temperature lower than or equal to 7° C. and for a time ranging from 5 to 15 minutes, under stirring;

iii) separation of the solid/liquid phases of said polymeric dispersion by filtration or centrifugation, obtaining a second cake comprising polymer and solvent/water mixture, in a ratio between solvent and water ranging from 60/40 to 85/15 by weight;

iv) redispersion of the second cake obtained in step iii) in the same solvent or water/solvent mixture of step ii) in a weight ratio ranging from 2 to 10 times the weight of the polymer in the cake, at room temperature or at a temperature lower than room temperature for a time ranging from 5 to 20 minutes, obtaining a homogeneous dispersion or "slurry" wherein the weight ratio between solvent/polymer ranges from 90/10 to 70/30;

v) heating the homogeneous dispersion or slurry obtained in step iv) until the complete dissolution of the polymer, preferably by passing the slurry into heat exchangers and obtaining a homogeneous spinning solution;

vi) feeding the homogeneous spinning solution obtained at the end of step v) to the spinning step.

The spinning step is carried out by means of a wet spinning process or dry-jet wet spinning process wherein, after the coagulation step in a coagulation bath consisting of a mixture of water and solvent, the bundle of filaments thus obtained is stretched and washed in succession up to a length of about 8-12 times the initial length, preferably 9-10 times, and then subjected to a final washing step with water to remove the last traces of solvent, the washing water then being fed again as recycled water in step i).

The spinning solution obtained from the process according to the present invention is advantageously free from gel and undissolved residues and can therefore be fed directly to the spinning line.

The present invention, in fact, allows a solution of homopolymers or copolymers of acrylonitrile to be obtained, gel-free and without the formation of insoluble agglomerates, increasing the advantages relating to polymerization in aqueous suspension, but eliminating the dangerous and expensive steps for drying the polymer, transporting the polymer in powder form to storage silos and the subsequent redissolution in solvent for spinning. The process according to the present invention therefore allows the two polymerization and spinning steps to be integrated in a simplified and economical way, without excluding however that, if of interest, the homogeneous spinning solution can be sent to an intermediate storage tank.

The polymerization process in aqueous suspension containing as solvent, the same solvent used in the subsequent dope preparation and spinning steps ii)-vi), allows the polymerization kinetics to be increased thanks to the increased solubility of the monomers in the reaction medium, allowing the time required for reaching the same conversion obtained with water alone, in accordance with the processes according to the state of the art, to be reduced by about 10-15%.

Furthermore, step iv), carried out by mixing pure solvent and polymer, is particularly easy, especially when the solvent is DMSO, as the powder already soaked in solvent with traces of water does not have the dispersion difficulties indicated in U.S. Pat. No. 4,403,055.

The close imbibition of the wet powder with the solvent, preventing the formation of coacerves which are difficult to disperse and dissolve, at the same time optimizes the formation of a fine and homogeneous suspension, as disclosed by U.S. Pat. No. 9,296,889 B2.

In the present description, the term polymer generally refers to both homopolymers obtained starting from acrylonitrile and copolymers obtained starting from acrylonitrile and one or more other comonomers.

In particular, polymers are high-molecular-weight polymers, ranging from 80,000 to 200,000 Da.

The polymerization step i) is carried out in aqueous suspension through the use of redox type catalysts, such as the ammonium persulfate/ammonium bisulfite pair in the presence of catalytic quantities of iron sulfate as a "promoter" of the formation of the radical species responsible for the polymerization itself, in the presence of a quantity of solvent that varies within the range of 3 to 25% by weight, preferably from 5 to 10% by weight, with respect to the total weight of the aqueous suspension, wherein the solvent is the same solvent used in the dope preparation and spinning steps ii)-vi).

Preferred solvents are dimethylformamide (DMF), dimethylacetamide (DMAc) and dimethylsulfoxide (DMSO).

Any possible solid comonomers (such as itaconic acid, acrylic acid and the like) can also be conveniently fed to the polymerization reactor in a solution of said solvents.

The water that constitutes the aqueous suspension comprises recycled water coming from the last washing section of the spinning line, in a quantity ranging from 10 to 40% by weight, preferably from 20 to 30% by weight, with respect to the total weight of the water of the aqueous suspension. This water, coming from the last washing step in the spinning process, contains small quantities (<0.5% by weight) of the same solvent and its use is particularly convenient in the polymerization reaction, reducing the overall consumption of demineralized water.

The polymerization step is terminated by adding an iron sequestering agent, such as EDTA in the form of sodium or ammonium salt, and the aqueous suspension, leaving the polymerization reactor, is subjected to the subsequent removal steps of the unreacted monomers, filtration of the aqueous suspension and washing of the same.

More specifically, the aqueous suspension leaving the reactor is fed to a suitable stripping column which separates the excess acrylonitrile and the unreacted volatile comonomers from the aqueous suspension, acrylonitrile and unreacted comonomers which are thus recycled to the polymerization step.

The aqueous suspension thus obtained containing polymer, residual salts of the catalytic system, traces of solvent and by-products of the reaction is fed, according to the known art, to a rotary vacuum filter which separates the liquid phase from the solids which form a cake on the surface of the filter. This cake is washed with warm water to remove the inorganic salts present and the filtration cake thus obtained at the end of the washing comprises polymer and water with traces of solvent in a ratio ranging from 40/60 to 60/40 by weight, preferably in a ratio ranging from 45/55 to 55/45 by weight, even more preferably in a weight ratio equal to or higher than 1:1.

In step ii) of the process according to the present invention, pure solvent or a water/solvent mixture is used, cold, i.e. at a temperature generally lower than or equal to 7° C. This temperature can also be below 0° C., if the freezing point of the solvent allows it.

The quantity of water in the solvent/water mixture of step ii) can vary from 0 to 20% by weight with respect to the total weight of the mixture.

Solvents suitable for being used in the various steps of the process according to the present invention, i.e. in step ii) and step iv), are the solvents commonly used for the formation of polymeric solutions for spinning acrylic fibers such as for example dimethylacetamide (DMAc), dimethylformamide (DMF) or dimethylsulfoxide (DMSO).

The conditions for obtaining the dispersion in step ii) must be such as not to allow the dissolution or swelling of the polymer granules, therefore the concentration of water in the solvent/water mixture, the operating temperature for obtaining said dispersion and the residence time in the stirred tank in which the dispersion is carried out, must be suitably defined.

In the dispersion of step ii), the filtration cake is dispersed in a quantity by weight of solvent/water or pure solvent mixture which ranges from 2 to 10 times the weight of the cake.

Under these conditions, i.e. at low temperatures, with a specific solvent that, in the case of a solvent/water mixture, provides for a precise quantity of water, the dispersion medium of step ii) does not have the solvent capacity for the polymer: more specifically, in step ii) the solid particles of the cake, also inside the granules of polymer itself, come into contact with the dispersion medium which soaks them with solvent or solvent/water mixture, effecting an exchange with the water present in the cake fed to step ii) and replacing this water with pure solvent or with the solvent/water mixture, comprising as already indicated, a small percentage of water.

The residence time is therefore a time sufficient for the water/solvent concentration in the dispersion medium to reach equilibrium, i.e. a time which is such that the dispersion medium of step ii) replaces the water soaked in the polymeric mass coming from step i) with pure solvent or with the water/solvent mixture. This condition is generally reached by keeping the dispersion under stirring for a time ranging from 5 to 15 minutes, thus obtaining a suitable polymeric dispersion.

In the subsequent step iii) the separation of the two solid/liquid phases, by filtration or centrifugation, leads to the formation of a second cake of polymer soaked in an aqueous solution very rich in solvent, which however does not have the capacity of dissolving the polymer.

The water content that remains in the second cake at the end of the filtration/centrifugation of step iii) will be in relation to: the water/solvent ratio used for redispersing the polymer of step ii), the quantity of water/solvent in which the first cake has been redispersed, and from the final liquid/solid ratio of the second cake obtained by filtration or centrifugation in step iii).

The liquid phase resulting from the filtration or centrifugation of step iii) is generally sent to a solvent recovery system by distillation or can be recycled to the dispersion step ii), after a possible correction of the titer with pure solvent.

The second cake deriving from step iii), of which the polymer/solvent/water ratio is now known, is transferred by means of a screw or belt conveyor system, to step iv) where, in a stirred tank, added to the solvent, it will form a slurry, subsequently transformed into dope by means of heat exchangers downstream.

In step iv), in fact, the second cake obtained in step iii) is redispersed in the same solvent or water/solvent mixture of step ii) in a weight ratio ranging from 2 to 10 times the weight of the polymer in the cake at room temperature or at a temperature below room temperature for a time ranging from 5 to 20 minutes, obtaining a homogeneous dispersion or "slurry". Temperature below room temperature also refers to a temperature of about 7° C. in the case of using DMSO and −5/−10° C. in the case of using solvents such as DMAc and DMF.

In step v), the slurry thus obtained is heated by means of a heat exchanger to a temperature ranging from 50 to 100° C., preferably from 60 to 90° C., for a time ranging from 3 to 60 minutes, at atmospheric pressure. This heating allows a homogeneous spinning solution containing from 12 to 22% by weight of polymer, from 1 to 10% by weight of water and from 68% to 85% by weight of solvent, to be obtained.

Figure 2:
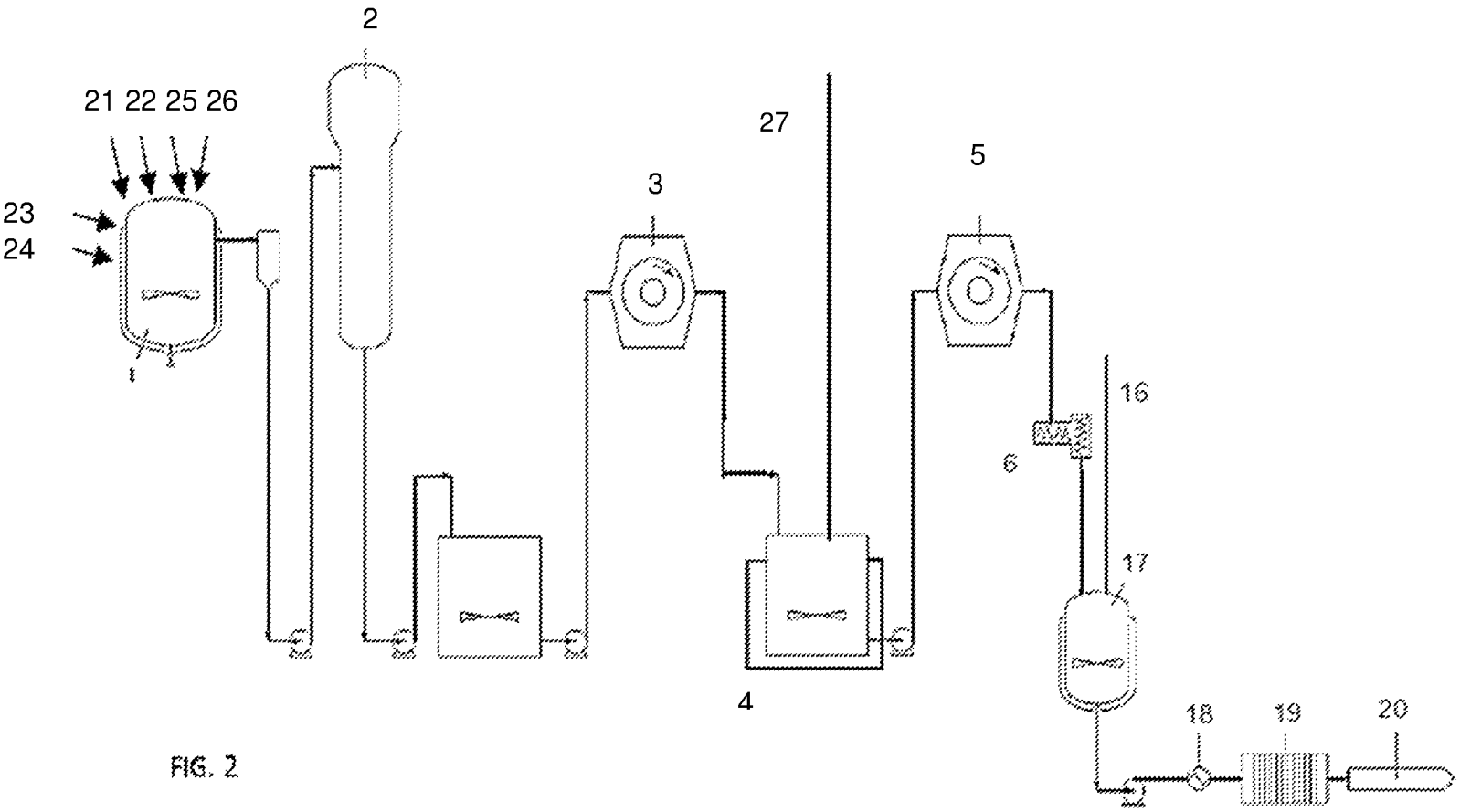

The specification comprises two figures:

FIG. 1, previously disclosed, is a schematic representation of a process according to the state of the art;

FIG. 2 is a schematic representation of an embodiment of the process according to the present invention.

An embodiment of the process object of the present invention is thus schematically described in FIG. 2.

A further advantage of the process according to the present invention is determined by the specific quantity of water contained in the spinning or dope solution which is then fed to the spinning step: the percentage of water that remains in the homogeneous solution for the production of acrylic fibers obtained with the process according to the present invention is in fact absolutely compatible with the acrylic fiber spinning technologies both according to the dry or wet spinning technology and according to the DJWS (dry jet wet spinning or air gap) technology: it is therefore not necessary to completely remove the water from the solution intended for spinning.

Furthermore, the presence of small percentages of water in the acrylic fiber spinning solutions as claimed in U.S. Pat. No. 3,932,577, facilitates the compatibility of the solution itself with the coagulation bath, leading to a fiber free from vacuoles and cracks; these characteristics are particularly advantageous in the production of precursors for carbon fibers or textile fibers with a good gloss and compact structure.

A further advantage linked to the presence of such small quantities of water in the dope is the possibility of conveying, both in the redispersion step ii) and in the preparation step of the slurry iv), water-soluble additives capable of providing the polymer and therefore the final fiber with particular performances.

Non-limiting examples of additives capable of providing the polymer and therefore the final fiber with particular performances are ammonia, primary amines, secondary amines, quaternary ammonium salts, salts of metal ions capable of salifying the ionic end groups of the polymer such as copper or silver, water-soluble polymers for modifying the rheology of the polymer solution, etc.

In particular, for carbon fiber precursors, it should be remembered that the addition to the polymeric solution of suitable quantities of ammonia or amines, as described in European patent application EP 3783132, further improves the extrusion of the fiber in the coagulation bath, providing even more compact and vacuole-free fibers, and increases the reaction kinetics in the oxidation/carbonization phase.

The spinning or dope solution thus obtained can be used immediately for feeding a suitable spinning line or it can be stored in heated tanks.

As previously indicated, in order to illustrate the process according to the state of the art, reference is made to the plant scheme described in FIG. 1 where acrylonitrile (21), the possible liquid comonomer (22), the aqueous solution of the catalytic system (23), the aqueous solution of the possible solid comonomer (24) and water (25), are fed to the polymerization reactor 1 in continuous. The polymer coming from the polymerization reactor 1 in the form of slurry in water, after treatment in the stripping column 2 for the removal of the unreacted monomers, is washed and filtered on a rotary filter 3 under vacuum. The powdered polymer is conveyed to the storage silos 14 through a drying unit 12, generally operating with hot air or nitrogen, and subsequently through the line 13, the polymer is fed by means of a screw or other conveyor means to a mixer element 15, where the fresh solvent also arrives through line 16 coming from the storage tanks.

In the mixer, 15 the powder polymer is dispersed in the solvent and the polymer slurry thus obtained is fed to a storage tank 17 and transformed into a spinning solution by means of the exchanger 18. The solution is then sent to a battery of filter presses 19, with selectivity cloths of 40 μm to 5 μm for the removal of possible particles and, through the line 20, to the spinning line or to a storage tank (not shown in FIG. 1).

In order to illustrate an embodiment of the process according to the present invention, reference is made hereunder to the plant diagram shown in FIG. 2, wherein the process is preferably carried out in continuous.

Acrylonitrile (21), the possible liquid comonomer (22), the aqueous solution of the catalytic system (23), the possible solid comonomer in solution of the same solvent used in spinning (24), the solvent (25) and water (26) also comprising the required amount of recycled water coming from the last washing section of the spinning line, are continuously fed to the polymerization reactor 1.

The polymer coming from the polymerization reactor 1 in the form of slurry in water, after treatment in the stripping column 2 for the removal of unreacted monomers, is washed and filtered on a rotary filter 3 under vacuum, resulting in a cake consisting of polymer and water which passes from step i) to step ii) of the process according to the present invention. The cake coming from the rotary filter 3 is then redispersed in a stirred tank 4 where a solvent/water mixture, possibly containing ammonia, or pure solvent, is fed through the line 27 at a low temperature. In the stirred tank 4, the suspension is kept at a temperature equal to or lower than 7° C. The resulting suspension is kept under stirring for a few minutes and is then fed to a second rotary filter or to a centrifugal separator 5, where step iii) of the process according to the present invention is effected. The mass soaked in water/solvent is fed, by means of a cochlea or another conveyor instrument 6, to a stirred tank 17, where the fresh solvent coming from the storage tanks also arrives through line 16 and the whole mixture is transformed into a spinning solution by means of the exchanger 18.

The solution is then sent to a battery of filter presses 19, with selectivity cloths of 40 μm to 5 μm for the removal of any undissolved particles and through line 20, to the spinning line or to a dope storage tank (not shown in FIG. 2).

The spinning line used can be of the wet-spinning type with spinnerets immersed in a coagulation bath consisting of a mixture of water and solvent. After coagulation, the bundle of filaments is stretched and washed in succession according to the known art to produce tows which are collected on bobbins or in boxes and then sent to the carbonization line for the production of carbon fiber. The solvent in the spinning step described herein is the same solvent already used in steps ii)-vi).

Alternatively, the spinning line used can be of the dry-jet wet spinning type (air-gap spinning) with spinnerets kept in the air at a small distance from the surface of the coagulum bath consisting of a mixture of water and solvent. After coagulation, the bundle of filaments is stretched and washed in succession according to the known art to produce tows which are collected on bobbins and then sent to the carbonization line for the production of carbon fiber. The solvent in the spinning step described herein is the same solvent already used in steps ii)-vi).

In both spinning techniques, demineralized water is used in the final washing steps of the fiber for removing the last traces of solvent. This water, after washing, contains traces of solvent and instead of being sent to the solvent recovery plant (operation not economically convenient) or to the waste water treatment (waste of water) it is fed back to the polymerization reactor 1, thus contributing to a decrease in the overall consumption. of water and to an energy saving.

EXAMPLES

By way of non-limiting example of the present invention, some embodiment examples of the process according to the present invention are provided hereunder.

Comparative Example 1 According to the Prior Art. Reference to FIG. 1

100 kg/h of acrylonitrile, 1 kg/h of methyl acrylate, 2 kg/h of itaconic acid dissolved in water at 5% by weight, 0.4 kg/h of ammonium persulfate dissolved in water, 0.5 kg/h of ammonium bisulfite dissolved in water, 2 g/h of iron sulfate dissolved in water and 250 kg/h of water with the addition of sulfuric acid sufficient for keeping the reaction pH at a value ranging from 2.0 to 3.5, were added continuously at a temperature of 62° C., to an aluminium reactor equipped with stirrer and overflow. The ingredients were fed at such a rate as to allow a residence time of 90 minutes. The reaction was stopped after 90 minutes by adding an aqueous solution of EDTA in the overflow and the slurry was fed to a stripping column where unreacted acrylonitrile and methyl acrylate were removed, obtaining a slurry of polymer in water at the bottom. A conversion of acrylonitrile to copolymer equal to 78% by weight of the feed to the reactor was obtained. The polymer was filtered, washed and dried as shown in FIG. 1 obtaining a powder stored in the silos 14. This polymer was subsequently dissolved in DMAc at a temperature of −10° C. by means of the static mixer 15 and the heat exchanger 18 shown. in FIG. 1. The solution thus obtained was filtered by means of a battery of filter presses with selectivity cloths progressively variable from 40 μm to 5 μm and fed to a wet spinning line with 24,000 hole spinnerets. At the end of the stretching and washing section with recovery water coming from the solvent recovery plant, a final washing step was carried out with demineralized water which was subsequently sent to waste water treatment.

At the end of the spinning process, 24 K precursor bobbins are obtained with the following characteristics:

Titer: 1.25 dtex;

Tenacity: 61.1 cN/tex;

Elongation: 15.2% suitable for the production of carbon fiber.

Example 2. Reference to FIG. 2

100 kg/h of acrylonitrile, 1 kg/h of methyl acrylate, 2 kg/h of itaconic acid dissolved in DMAc, 0.4 kg/h of ammonium persulfate dissolved in water, 0.5 kg/h of ammonium bisulfite dissolved in water, 2 g/h of iron sulfate dissolved in water and 200 kg/h of water with the addition of sulfuric acid sufficient for keeping the reaction pH at a value ranging from 2.0 to 3.5, 40 kg/h of water coming from the last washing step of the spinning phase and 15 kg/h of DMAc, were added continuously at a temperature of 62° C. to an aluminium reactor equipped with stirrer and overflow. The ingredients were fed at such a rate as to allow a residence time of 90 minutes. The reaction was stopped after 90 minutes by adding an aqueous solution of EDTA in the overflow and the slurry was fed to a stripping column where unreacted acrylonitrile and methyl acrylate were removed and a slurry of polymer in water was obtained at the bottom. A conversion of acrylonitrile to copolymer equal to 84% by weight of the feed to the reactor was obtained.

The polymer coming from the polymerization reactor in the form of slurry in water, after treatment in a stripping column for the removal of unreacted monomers, was washed and filtered on a rotary filter under vacuum resulting in a cake consisting of polymer (53% by weight) and water (47% by weight).

100 kg of this cake were transferred to a stirred tank and 255 kg of pure dimethylacetamide, kept at a temperature of −10° C., were added. The resulting suspension was kept under stirring in the tank cooled at this temperature for 5 minutes and then fed to a rotary vacuum filter which, after filtration, allowed a mass containing 40% by weight of DMAc, 9% by weight of water and 51% by weight of polymer, to be obtained.

The cake discharged from the filter was transferred to a stirred tank containing 148 kg of DMAc maintained at a temperature of −5° C. and kept under stirring for 10 minutes, producing a slurry containing 21% by weight of polymer, 75% by weight of DMAC and 4% by weight of water.

This slurry was then transferred through a gear pump to the transformation step into dope, which was carried out using:

a tube-bundle heat exchanger;

a static mixer for homogenization;

a battery of filter presses with selectivity cloths progressively variable from 40 μm to 5 μm.

The dope thus produced was fed to a wet spinning line with 24,000-hole spinnerets immersed in a coagulation bath containing 60% of DMAc and 40% of water and kept at 55° C. The bundle of filaments thus obtained was stretched, in succession, 10 times its initial length and washed. At the end of the stretching and washing section with recovery water coming from the solvent recovery plant, a final washing step was carried out with demineralized water which was subsequently sent to the polymerization reactor 1 of FIG. 2. At the end of the spinning process the tow was collected on bobbins at a rate of 70 m/min, obtaining 24 K precursor bobbins with the following characteristics:

Titer: 1.22 dtex;

Tenacity: 59.5 cN/tex:

Elongation: 14.5%;

suitable for the production of carbon fiber.

Example 3. Reference to FIG. 2

100 kg/h of acrylonitrile, 2 kg/h of methyl acrylate, 2 kg/h of itaconic acid dissolved in DMSO, 0.4 kg/h of ammonium persulfate dissolved in water, 0.5 kg/h of ammonium bisulfite dissolved in water, 2 g/h of iron sulfate dissolved in water and 200 kg/h of water with the addition of sulfuric acid sufficient for keeping the reaction pH at a value ranging from 2.0 to 3.5, 40 kg/h of water coming from the last washing step of the spinning phase and 25 kg/h of DMSO, were added continuously at a temperature of 62° C. to an aluminium reactor equipped with stirrer and overflow.

The ingredients were fed at such a rate as to allow a residence time of 90 minutes. The reaction was stopped after 90 minutes by adding an aqueous solution of EDTA in the overflow and the slurry was fed to a stripping column where unreacted acrylonitrile and methyl acrylate were removed and a slurry of polymer in water was obtained at the bottom. A conversion of the acrylonitrile to copolymer equal to 86% by weight of the feed to the reactor was obtained.

The polymer coming from the polymerization reactor in the form of slurry in water, after treatment in a stripping column for the removal of unreacted monomers, was washed and filtered on a rotary vacuum filter resulting in a cake consisting of polymer (55% by weight) and water (45% by weight).

100 kg of this cake were transferred to a stirred tank and 570 kg of a mixture consisting of DMSO (80%) and water (20%), kept at a temperature of 7° C. were added. The resulting suspension was kept under stirring in the tank cooled at this temperature for 5 minutes and then fed to a rotary filter which, after filtration, allowed a mass containing 42% by weight of DMSO, 10% by weight of water, and 48% by weight of polymer, to be obtained.

The cake discharged from the filter was transferred to a stirred tank containing 180 kg of DMSO, producing a slurry containing 19% by weight of polymer, 77% by weight of DMSO and 4% by weight of water. This slurry is then transferred through a gear pump to the transformation step into dope, which was carried out using:

a tube-bundle heat exchanger;

a static mixer for homogenization;

a battery of filter presses with selectivity cloths progressively variable from 40 μm to 5 μm.

The dope thus produced was fed to a dry-jet wet spinning line with 3,000 hole spinnerets positioned at a distance of 4 mm from the surface of the coagulation bath containing 35% of DMSO and 65% of water at a temperature of 5° C. The bundle of filaments obtained after coagulation was stretched in water and subsequently in steam (steam stretching) nine times its initial length and finally washed to remove the solvent still present. At the end of the stretching and washing section with recovery water coming from the solvent recovery plant, a final washing step was carried out with demineralized water which was then sent to the polymerization reactor 1 of FIG. 2. At the end of the spinning process, 12 K precursor bobbins were obtained by superimposing four 3K tows coming from the single spinneret. The fiber obtained, collected on bobbins at a rate of 240 m/min, has a perfectly round section, is compact, free of cracks and has the following characteristics:

Titer: 1.0 dtex;

Tenacity: 65.3 cN/tex;

Elongation: 14.1% suitable for the production of carbon fiber.

The invention claimed is:

1. An integrated process for the production of acrylic fibers comprising the following steps:

i) polymerizing comonomers in aqueous suspension in the presence of a quantity of solvent ranging from 3 to 25% by weight, with respect to the total weight of the aqueous suspension, wherein the solvent is the same solvent used in the following steps ii)-vi) and wherein the water that constitutes the aqueous suspension comprises recycled water coming from a last washing step of the spinning step, in an amount ranging from 10 to 40% by weight, with respect to the total weight of the water of the aqueous suspension, said polymerization being catalyzed by a redox ammonium persulfate/ammonium bisulphite pair in the presence of catalytic quantities of iron sulfate, with the subsequent removal of the unreacted monomers, first filtration of the aqueous suspension and washing of the same, obtaining a first filtration cake comprising polymer and water with traces of solvent in a ratio ranging from 40/60 to 60/40 by weight;

ii) dispersing said first filtration cake obtained in step i) in a solvent/water mixture or in a pure solvent in a weight ratio ranging from 2 to 10 times the weight of the cake and for a time ranging from 5 to 15 minutes, under stirring, to provide a polymeric dispersion;

iii) separating the solid/liquid phases of said polymeric dispersion by filtration or centrifugation, obtaining a second cake comprising polymer and solvent/water mixture, in a ratio between solvent and water ranging from 60/40 to 85/15 by weight;

iv) redispersing the second cake obtained in step iii) in the same solvent or water/solvent mixture of step ii) in a weight ratio ranging from 2 to 10 times the weight of the polymer in the cake, at room temperature or at a temperature lower than room temperature for a time ranging from 5 to 20 minutes, obtaining a homogeneous dispersion or slurry wherein the weight ratio between solvent/polymer ranges from 90/10 to 70/30;

v) heating the homogeneous dispersion or slurry obtained in step iv) until the complete dissolution of the polymer and obtaining a homogeneous spinning solution;

vi) feeding the homogeneous spinning solution obtained at the end of step v) to a spinning step.

2. The process according to claim 1, wherein the spinning step is carried out by means of a wet spinning process or dry-jet wet spinning process wherein, after a coagulation step in a coagulation bath consisting of a mixture of water and solvent, a bundle of filaments thus obtained is stretched and washed in succession up to a length of about 8-12 times the initial length, then subjected to a final washing phase with water to remove the last traces of solvent, the washing water then being fed again as recycled water in step i), comprising a quantity of solvent lower than 0.5% by weight.

3. The process according to claim 1, wherein the polymerization step i) is terminated by adding an iron sequestering agent and the aqueous suspension is subjected to the subsequent steps for removing the unreacted monomers, filtering the aqueous suspension and washing it to obtain the first filtration cake comprising polymer and water with traces of solvent in a ratio ranging from 45/55 to 55/45 by weight.

4. The process according to claim 1, wherein in steps i)-vi) and in the spinning step, the solvent is the same.

5. The process according to claim 1, wherein in step ii), the temperature is lower than 0° C.

6. The process according to claim 1, wherein the quantity of water in the solvent/water mixture of step ii) varies from 0 to 20% by weight with respect to the total weight of the mixture.

7. The process according to claim 1, wherein in step iv), the temperature is equal to 7° C.

8. The process according to claim 1, wherein the homogeneous spinning polymeric solution has a polymer content ranging from 12 to 22% by weight with respect to the total weight of the spinning solution.

9. The process according to claim 1, wherein in steps iii) and iv), water-soluble additives are added.

10. The process according to claim 1, wherein the polymers are high-molecular-weight polymers, said high molecular weight ranging from 80,000 to 200,000 Da, or they are medium-molecular-weight polymers, said medium molecular weight ranging from 40,000 to 55,000 Da.

11. The process according to claim 1, wherein the acrylic fibers comprise an acrylonitrile copolymer wherein acrylonitrile is in an amount ranging from 90 to 99% by weight with respect to the total weight of the copolymer and one or more comonomers is in an amount ranging from 1 to 10% by weight with respect to the total weight of the copolymer.

12. The process according to claim 10, wherein the comonomers are selected from neutral vinyl compounds; compounds bearing one or more acid groups; and compounds capable of imparting different chemical-physical characteristics to the polymer.

13. The process according to claim 1, wherein polymerizing comonomers in aqueous suspension is in the presence of a quantity of solvent ranging from 5 to 10% by weight, with respect to the total weight of the aqueous suspension.

14. The process according to claim 1, wherein the water that constitutes the aqueous suspension comprises recycled water coming from the last washing step of the spinning step, in an amount ranging from 20 to 30% by weight, with respect to the total weight of the water of the aqueous suspension.

15. The process according to claim 1, wherein dispersing said first filtration cake obtained in step i) is at a temperature lower than or equal to 7° C.

16. The process according to claim 1, wherein heating the homogeneous dispersion or slurry obtained in step iv) is achieved by passing the homogeneous dispersion or slurry into heat exchangers.

17. The process according to claim 2, wherein the bundle of filaments obtained is stretched and washed in succession up to a length of about 9-10 times the initial length.

18. The process according to claim 3, wherein the iron sequestering agent is EDTA in the form of sodium or ammonium salt.

19. The process according to claim 3, wherein the first filtration cake comprises polymer and water with traces of solvent in a ratio ranging from 1:1 by weight.

20. The process according to claim 1, wherein the solvent is selected from the group consisting of dimethylacetamide (DMAc), dimethylformamide (DMF) and dimethylsulfoxide (DMSO).

* * * * *